US005931595A

United States Patent [19]

Van Oost

[11] Patent Number: 5,931,595

[45] Date of Patent: Aug. 3, 1999

[54] DEVICE FOR APPLYING A LIQUID PRODUCT

[76] Inventor: Stéphane Van Oost, avenue Englebert 24, 1331 Rosières, Belgium

[21] Appl. No.: 08/696,966

[22] PCT Filed: Feb. 24, 1995

[86] PCT No.: PCT/BE95/00018

§ 371 Date: Aug. 23, 1996

§ 102(e) Date: Aug. 23, 1996

[87] PCT Pub. No.: WO95/23033

PCT Pub. Date: Aug. 31, 1995

[30] Foreign Application Priority Data

Feb. 24, 1994 [BE] Belgium ..... 9400211

[51] Int. Cl.[6] ..... B05C 17/03

[52] U.S. Cl. ..... 401/147; 401/197; 401/218; 401/220

[58] Field of Search ..... 401/218, 220, 401/197, 147

[56] References Cited

U.S. PATENT DOCUMENTS

| | | | |
|---|---|---|---|
| 2,722,029 | 11/1955 | Barnes et al. | 401/197 |
| 3,138,814 | 6/1964 | Carrona | 401/218 X |
| 3,149,365 | 9/1964 | Adair, Jr. | 401/36 |
| 3,549,267 | 12/1970 | Wurzer et al. | 401/197 X |
| 4,175,300 | 11/1979 | McGlew et al. | 401/197 X |
| 4,217,062 | 8/1980 | Trp et al. | 401/44 |
| 4,422,789 | 12/1983 | Charney et al. | 401/218 |
| 4,537,522 | 8/1985 | Charney et al. | 401/218 |
| 4,588,318 | 5/1986 | O'Brien et al. | 401/197 X |

FOREIGN PATENT DOCUMENTS

| | | | |
|---|---|---|---|
| 589937 | 3/1959 | Italy | 401/218 |

*Primary Examiner*—Steven A. Bratlie
*Attorney, Agent, or Firm*—Birch, Stewart, Kolasch & Birch, LLP

[57] ABSTRACT

A device for applying a liquid product, in particular paint, includes an applicator with at least one roller, a supply unit with a variable speed, volumetric pump, and a duct connecting the pump to the applicator. The pump is connected to a control unit. A detector detects a speed of the roller and provides a control signal corresponding to the speed to the control unit. The control unit includes a regulator for setting a linear relationship between the speed of the pump and the speed of the roller. The control unit controls the liquid product flow rate supplied by the pump based upon the control signal and the linear relationship set by the regulator.

13 Claims, 4 Drawing Sheets

Fig.1
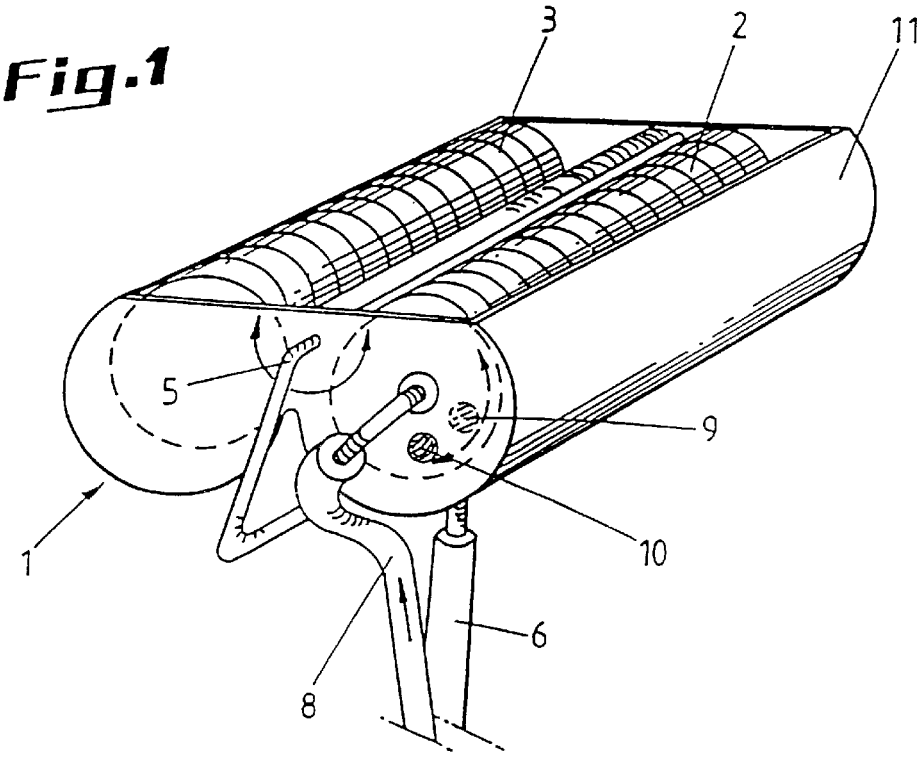
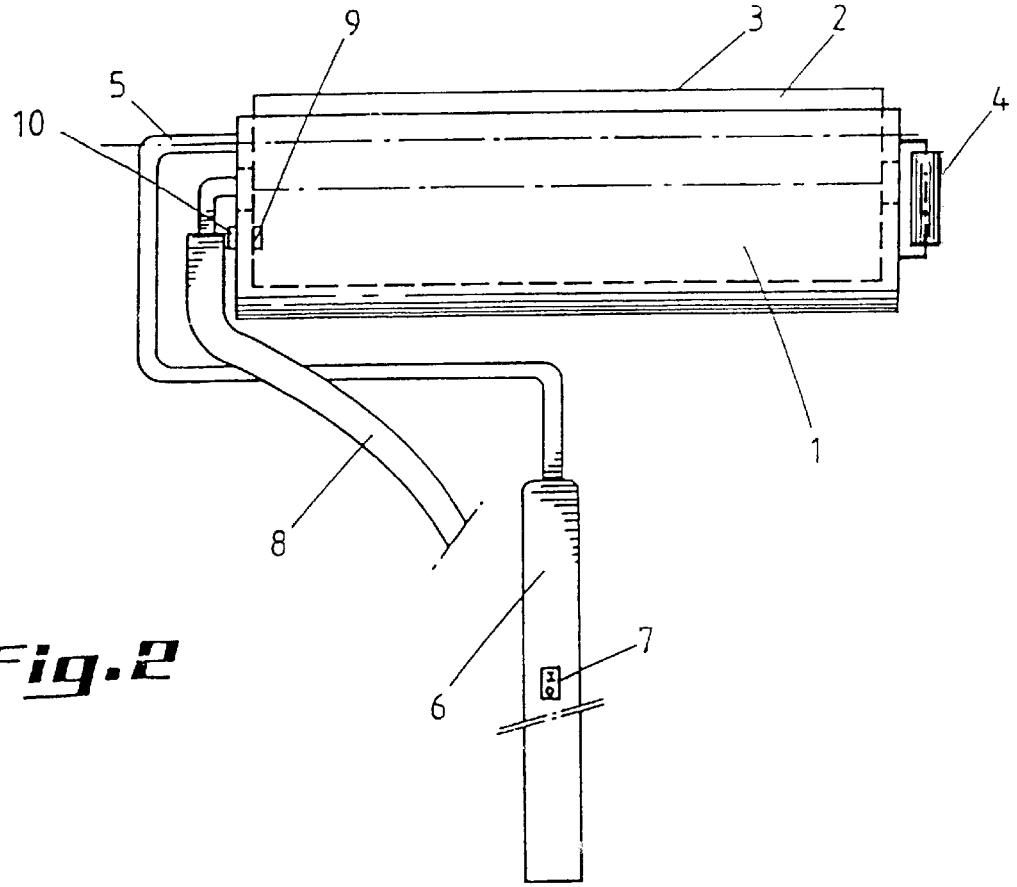
Fig.2

DEVICE FOR APPLYING A LIQUID PRODUCT

The invention relates to a device for applying a liquid product, in particular paint, comprising an applicator with at least one roller provided for applying the product on a surface and a supply unit provided with a pump and an at least partially flexible duct connecting the pump to the applicator, said pump being connected to a control unit provided for controlling the flow of the liquid to be supplied based upon a measured speed of the roller on the surface.

Such a device is known from U.S. Pat. No. 3,549,267. According to the known device, the paint is supplied from a container by means of a pump via the duct towards the roller, in order to be applied on the surface. The speed at which the roller moves on the surface on which the paint is applied, is measured by means of a detector which generates the control signal indicative for that roller speed. The control signal, formed by a sequence of switching pulses, is supplied to a control unit, which under control of that control signal, regulates the flow rate of paint towards the roller. In such a manner, the supply of paint is controlled by the roller speed.

A drawback of the known device is that for controlling the flow rate of paint, use is made of a flow switch, which is switched on or off in function of the sequence of the switching pulses, which form the control signal. Consequently, the pressure within the duct varies in an asymptotic manner which causes a non-linear throughout of the liquid within the duct, leading to an unequal thickness of the paint applied on the surface.

SUMMARY OF THE INVENTION

It is an object of the present invention to provide a device for applying a liquid product to a surface which enables the product to be applied on the surface with a substantially equal thickness.

A device according to the present invention is therefore characterized in that a volumetric pump, provided for operating at an adjustable pump speed, is used in combination with a control unit comprising a regulator for setting at least one linear relationship between said roller speed ($V_r$) and said pump speed ($V_p$). The use of a volumetric pump enables one to control the pump speed ($V_p$) and thus one can obtain a flow of liquid which is proportional to that pump speed. Upon setting a linear relationship between the roller speed ($V_r$), which is measured by the detector, and the pump speed, it is possible to have the pump speed changed linearly in relation to the measured change of the roller speed. So, a change of the roller speed will cause a proportional change of the pump speed, thus causing a proportional change in the flow rate of the supplied liquid. The set linear relationship causes a constant ratio between the pump speed and the roller speed so that the liquid supply will follow the roller speed enabling an application with a substantially equal thickness of the liquid product on the surface.

It has to be noted that the patent application GB-A-2.263.508 describes a device wherein the supply of liquid is determined as a function of the speed of the movement. However, the roller which measures that speed is not the one which applies the liquid. The only task of that roller is to measure the speed. The liquid is applied by means of an ejector. Moreover, that device does not comprise a control unit enabling adjustment of the ratio between the flow and the speed of the roller. In that device, the pump is driven by the movement of the roller which is not compatible with strongly fluid liquids which are sucked and not pushed towards the applicator.

The patent application DE-A-3,526,257 also describes a device for applying a liquid product on a surface. In that device a buffer zone is adjacent to the application roller. The liquid, in particular paint, is pumped in that buffer zone which then supplies the roller. The rotation of the roller provokes a suction which brings the paint from the buffer zone on the roller. The suction force is a function of the roller rotation speed. The solution described in DE-A-3,526,257 does not comprise the measurement of the notion speed of the roller and is therefor distinguished from the one of the present invention.

A first preferred embodiment of a device according to the invention is characterized in that said control unit is provided for starting the return of the liquid when the control signal indicates a value corresponding to a stop of the motion. This enables stopping the supply of a liquid product upon a stop of the roller, and thus prevents an oversaturation at a place of the surface where the roller is stopped, and avoids that liquid product overflows from the applicator. Indeed it is necessary to decompress the column of paint which is established between the pump and the roller for stopping completely the supply of product towards the roller.

Preferably, the control unit is provided for stopping said return of the liquid after a lapse of a predetermined time period counted as from said starting. If the return would be continued too long the duct would be emptied and it would be necessary to restart the supply of product when the work starts again, thus causing a loss of time. By thus stopping, the return product is kept in the duct and the user can immediately start after an interruption even longer than the predetermined period.

A second preferred embodiment of a device according to the invention is characterized in that the control unit is provided with a regulator enabling a user to modify the ratio between the liquid flow and said motion speed of the roller on the surface. The ratio between the flow and the speed of the roller defines the thickness of the paint. The regulator enables a user to modify that ratio and thus to modify the thickness of the paint layer. After the regulator has been positioned to the chosen value, the ratio will be kept constant at that value according to the flow regulation line. The chosen thickness of the layer applied on the surface is thus obtained, whatever be the speed at which the user makes the roller progress.

A third preferred embodiment of a device according to the invention is characterized in that said applicator comprises two rollers applied in parallel, said duct being connected to an internal cavity of one of said rollers. This offers the advantage that one roller furnishes the liquid and the other spreads it. The roller which is not furnished will thus not be saturated by the product which enables using it for spreading the liquid and thus obtain a uniform application of the liquid product.

A fourth preferred embodiment of a device according to the invention is characterized in that the supply unit comprises at least two pumps provided for supplying the same applicator with different liquid products, and said control unit controls individually the flow of each pump. This enables one to mix two products and to control the supply of each product individually.

Preferably said pump is a peristaltic pump driven by an engine having a controllable speed. A peristaltic pump enables one to easily control the flow, because that type of volumetric pump has a flow proportional to the rotation speed of the engine which drives the latter.

A fifth preferred embodiment of a device according to the invention is characterized in that said applicator comprises protection screens mounted in parallel to the roller axis. This enables one to butt against ceilings, plinths or other contiguous borders without the roller touching those borders, which enables one to increase the working speed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 represents, in perspective, a device with a double roller according to the invention,.

FIG. 2 represents, from the side the device with a double roller according to the invention.

Figure 3:
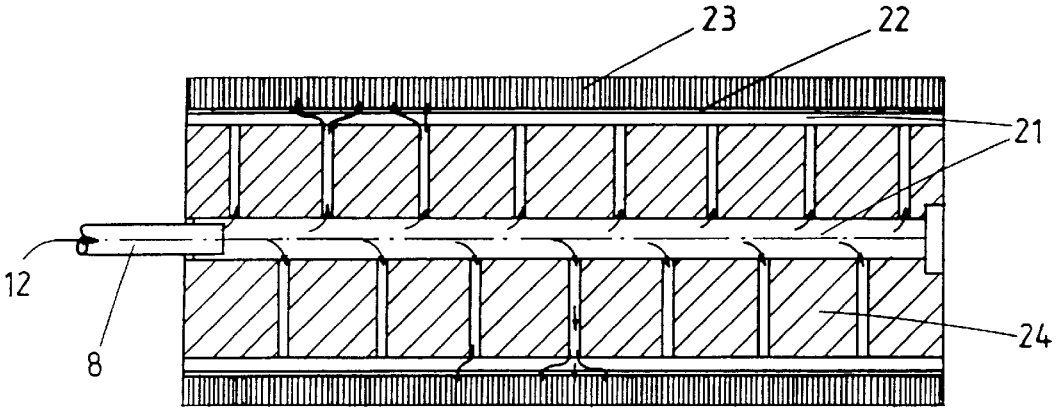
FIG. 3 represents a schematical section through the roller 1 of the applicator.

In the drawings same reference numerals have been assigned to a same or an analogous element. In the description which follows reference is made to a device used for the application of paint on a surface. However, the device according to the invention is not limited to the application of paint, and other liquid products, such as for example glue, etching reagent, or coatings based on bitumen, can also be applied by this device.

DETAILED DESCRIPTION OF THE INVENTION

FIGS. 1 and 2 represent an example of an applicator being part of the device according to the invention. The applicator comprises two rollers 2 and 3 aligned in parallel, wherein both slightly protrude from an opening of the housing 1. The first roller 2, represented in detail in FIG. 3, comprises an internal cavity 21 which is supplied with paint via a supply duct 8. The duct is at least over a part of its length flexible. The paint is uniformly distributed on the external periphery of the roller and passes through the permeable cylinder 22 which supports the external skin 23 of the roller. The cavity can partially be filled with non-saturable light foam 24. The second roller 3 spreads out the paint applied by the first. The housing 1 is guided by the displacement of the two rollers 2 and 3 in such a manner that it is maintained in parallel to the surface to be painted. It thus collects all the splatters of the paint.

In the example shown in FIGS. 1 to 3, the device comprises two rollers. However, a device with a single roller could also be considered. The device comprises then only the roller 2. Also, the supply duct can partially be formed by the handle on which the applicator is mounted.

The housing is provided with protection screens 11 mounted in parallel to the axis 12 of the roller. Those screens envelop the rollers, as well as, butt against the ceiling, the plinths, the frames of the doors and the windows and all other contiguous borders, without the rollers touching those borders. The working speed can thus be increased because the user will have to take less care and must not mask these borders.

The set 1, 2 and 3 is free in rotation around the axis 5 which is part of the handle 6 of the applicator. One or more small rollers 4 can, as the case may be, be applied on the sides of the housing 1 which enables painting more closely to the corners and the borders without too many precautions. Axis 5 of the handle is disposed over the center of gravity of the set 1, 2 and 3 when the housing 1 is disposed with its open face directed towards the top. The open face of the housing directed towards the top is thus in an equilibrium position. This takes care that no overflow of paint will take place during the several handlings.

An electrical command 7 adapted on the handle 6 enables the start and the stop of the paint supply unit. A speed detector 9, 10 of the motion of the roller on the surface measures the rotation speed of the first roller 2. The detector comprises, for example, a first permanent magnet 9 fixed on the first roller 2 and a second magnet fixed on the housing 1. Each time that the first magnet passes before the second, a pulse is produced. The succession of pulses thus produced then forms a control signal corresponding to the speed of the roller on the surface. The frequency of the pulses is, for example, transformed into a voltage which is proportional to the frequency and thus to the speed of the roller. The flow is controlled to that speed measurement by means of the control unit.

Figure 4A:
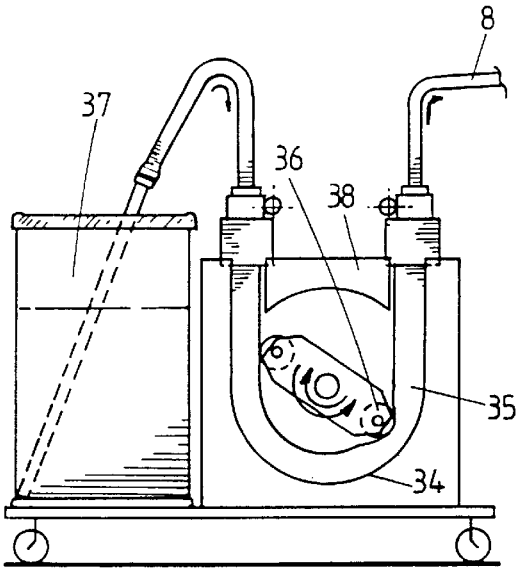
FIGS. 4*a* and 4*b* schematically represent a side view and a lateral view, respectively, of the peristaltic pump with controllable flow being part of a device according to the invention.
Figure 4B:
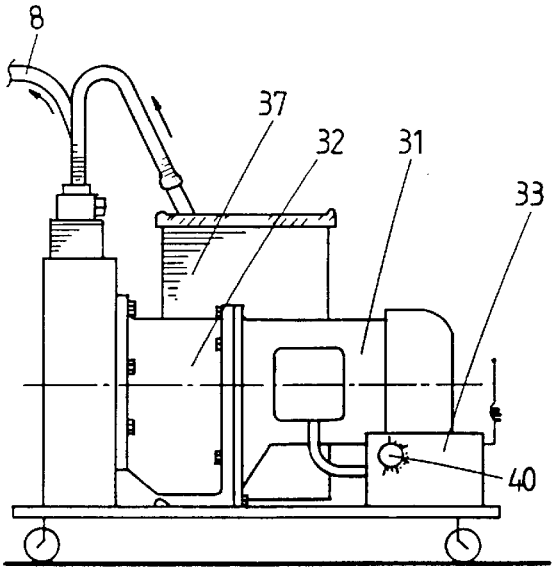

The supply of paint to the roller 2 is accomplished by a pump 38 placed between the duct 8 and the paint container 37 or another liquid product container, such as illustrated in FIGS. 4A and 4B. The pump is preferably a peristaltic pump because it enables a reliable control of the flow of paint desired by the user. Indeed, that type of volumetric pump has a flow proportional to the rotational speed of the engine 31 which drives the latter.

The electrical engine 31 drives, via a reductor 32, the axis of the pump on which two small rollers 36 are fixed. The reduced space between the small rollers 36 and a jaw of the pump body 34 provokes a squeezing of a tube 35. The displacement of the small rollers along the tube 35 provokes the pumping and the supply of paint from the container 37 towards the applicator via the duct 8. The flow of paint thus depends solely on the speed of the engine 31 controlled by the control unit 33.

Figure 5:
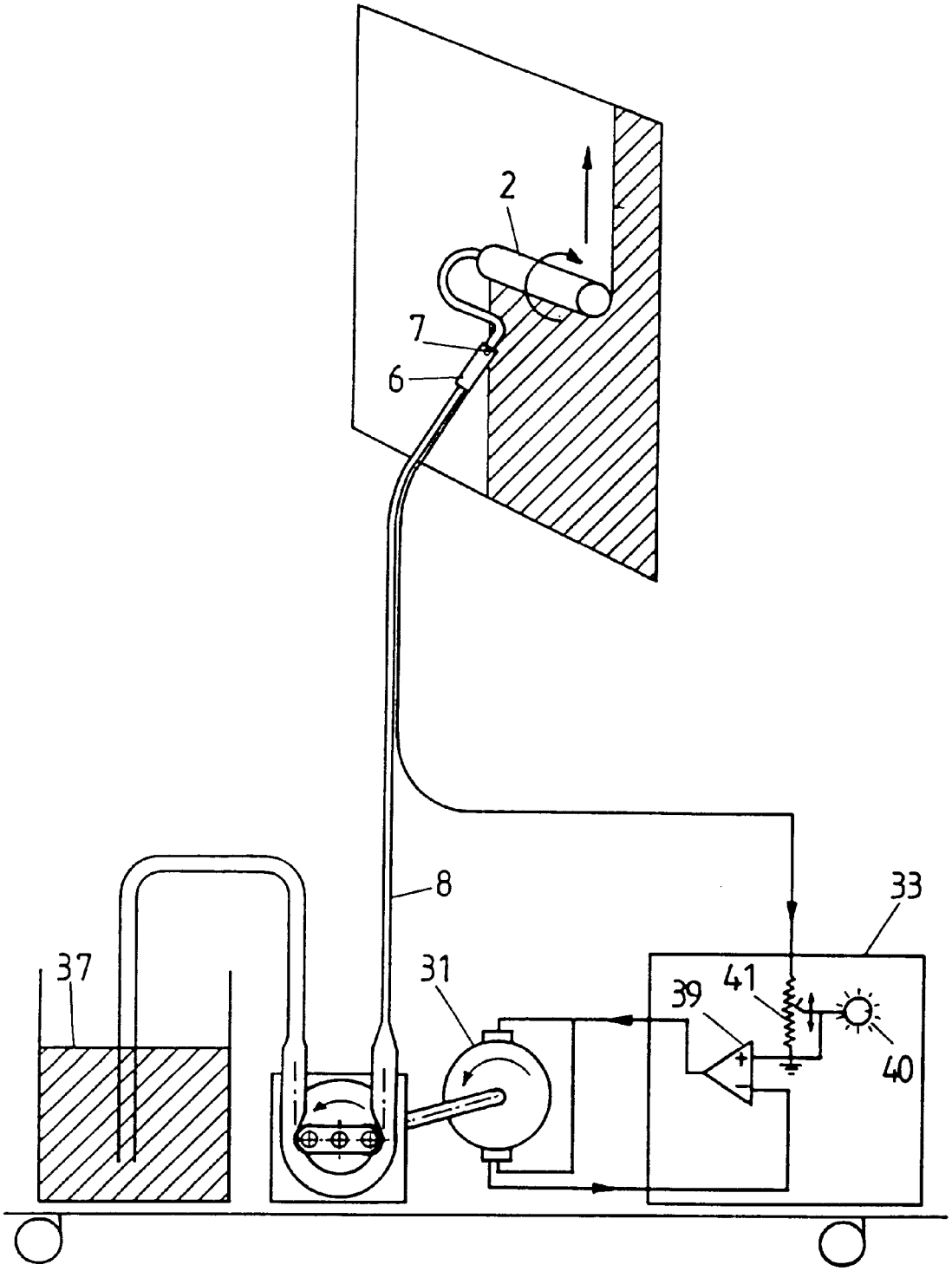
FIG. 5 schematically illustrates the control of the flow as a function of the speed.
Figure 6:
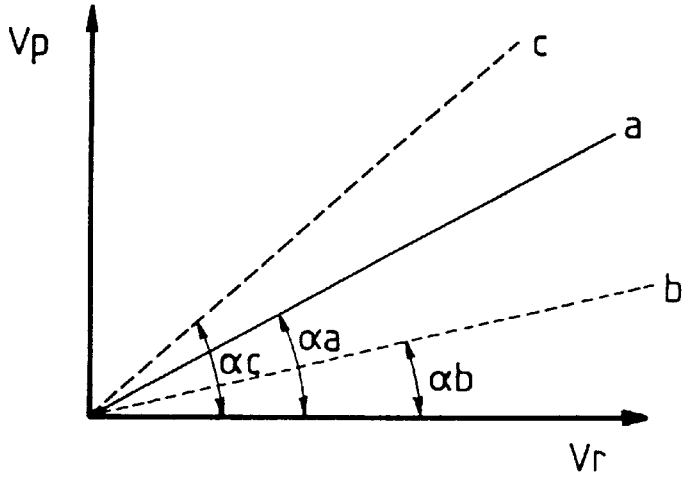
FIG. 6 shows a graph illustrating the ratio between the flow and the speed of the roller.

As illustrated in FIG. 5, the control unit 33 receives the control signal furnished by the detector. The control signal is also furnished to a variable resistance 41 an output of which being connected to a first input of a comparator circuit 39. A second input of the comparator circuit 39 is connected to engine 31 and receives a signal indicating the speed of the engine. The variable resistance 41 is controlled by means of a regulator 40, which enables modification of the ratio between the liquid flow and the motion speed of the roller on the surface. FIG. 6 shows a graph indicating the relation between the rotation speed $V_r$ of the roller and the rotation speed $V_p$ of the pump which is proportional to the flow of supplied liquid. The regulator 40 enables selecting a ratio $V_r/V_p$ according to a slope αa, αb or αc. The regulation lines a, b and c indicate different ratios.

Before starting the painting work, the user will choose by means of the regulator 40 a ratio $V_r/V_p$ according to the thickness of the layer to be applied. The ratio thus indicated will position the variable resistance 41 to a value corresponding to that ratio. The control signal furnished by the speed detector and the signal indicating the speed of the engine, weighed by the resistance 41 will permanently be compared by the comparator circuit 39 which then furnishes at its output a control signal for the engine 31. When the speed of the roller increases or decreases, the comparator 39 will establish a difference between the signals furnished at its input and will modify the speed of the engine in order to equalize that difference. The flow of liquid furnished by the pump is thus controlled by the control signal indicating the speed of the roller. Because the ratio between the flow and the speed of the roller defines the thickness of the paint and because this ratio is maintained constant according to the chosen regulation line, the thickness will thus be maintained constant whatever be the speed at which the user makes the roller progress.

The control unit 33 is also capable of handling an instantaneous stop of the movement of the roller and for starting a return of the liquid in case of a stop. When the control signal furnished to the first input of the comparator 39 is a signal indicating a value $V_r=0$ indicating the stop of the roller, the comparator circuit will produce a control pulse provoking a reverse rotation of the engine 31. The motor will pump the liquid within the duct 8 towards the container 37. This will empty the roller 2 and avoid an overflow of the roller due to pressure residues within the pump and within the duct.

In order to avoid an undesired return of liquid and emptying of the supply duct 8, which would thus require a reinitiation of the device when work was resumed, return begins a predetermined time period starting from the moment when the rotation of the engine is reversed. To this purpose, the control unit comprises, for example, an RC circuit programmed for the period of time.

In the case where two or more different liquid products should be mixed, the device according to the invention can be equipped with several pumps, each being provided with their own control unit or sharing a control unit with another pump.

Thanks to the device according to this invention, no control of the viscosity of the paint is required and the paint can comprise solid particles without affecting functioning of the pump. Moreover, the emptying of the peristaltic pump and the applicator is simplified because the flow of paint can be reversed by the reverse operation of the engine, thus emptying the apparatus. The cleaning is further facilitated by a quick connection on the duct 8 for connecting to a water supply. Changing the duct 8 of the peristaltic pump to another one facilitates a rapid change of paint color.

The housing of the applicator comprising the two rollers avoids the problems of splashes and masking is no longer necessary. The applicator allows in one operation, the supply and spreading out of the paint thanks to the double roller. Thus, the application of paint on the wall can be realized by up and down movements from the upper end of the wall to the lower end. A telescopic handle is preferably used because it enables the operator to use both hands. For painting the ceilings, the extensible handle is used in a vertical position on a rolling support. It is no longer necessary to cross stroke the painting because the spreading out is uniform after the first run. One paint layer is sometimes enough, because a supply of paint can be controlled better than with one classical roller, for an acceptable final result. The efficiency and the comfort of the painter are thus substantially improved and the quality of the work is superior.

Figure 7:
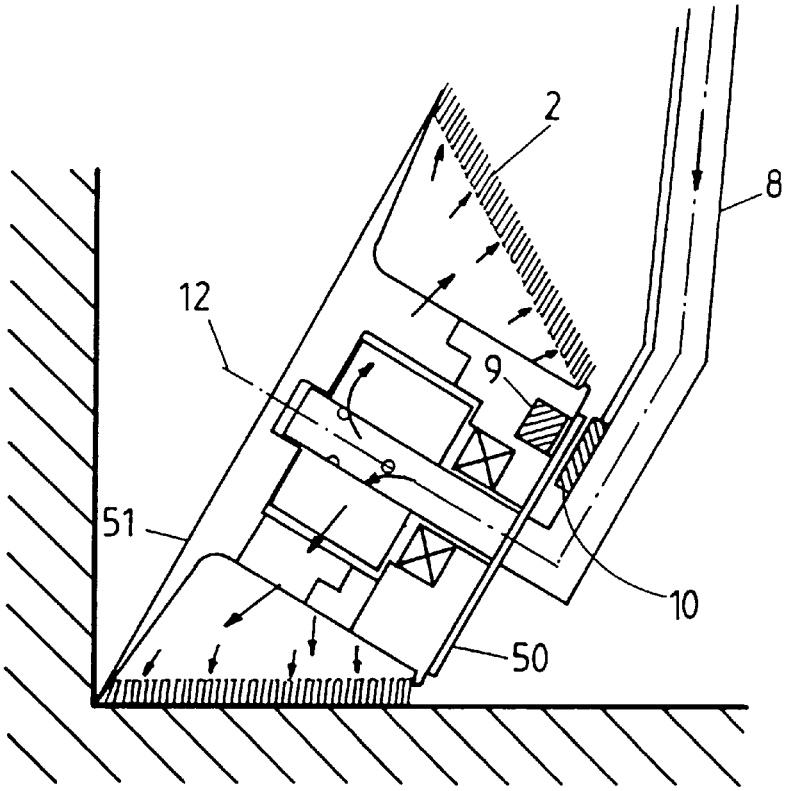
FIG. 7 represents a section through the roller having a truncated cone shape.

A particular type of roller, such as presented in FIG. 7, preferably has the form of a truncated cone of which the circular bases 50, 51 are impervious to the liquid product used. This type of roller enables painting in tight corners using the previously disclosed pump. The standard cylindrical rollers 2 and 3 can paint surfaces with the exception of those tight corners. The rapid connector on the duct 8 enables connecting the conical roller instead of the standard roller.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

I claim:

1. A device for applying a liquid product comprising:

an applicator including at least one roller for applying the liquid product on a surface;

a detector provided for detecting a speed ($V_r$) of said at least one roller, as said at least one roller rolls along said surface, wherein said detector is further provided for generating a control signal relating to said roller speed;

a supply unit including a volumetric pump, provided for operating at an adjustable pump speed ($V_p$);

a duct connecting said pump to said applicator, wherein said duct is at least partially flexible; and a control unit comprising a regulator for setting at least one linear relationship between said roller speed ($V_r$) and said pump speed ($V_p$), wherein said control unit is provided for receiving said control signal from said detector and for controlling a flow rate of said liquid product from said pump to said at least one roller based upon the control signal and a set linear relationship.

2. The device as claimed in claim 1, wherein said regulator comprises a memory for storing a set of said linear relationships and a selector for selecting each of said relationships within said set.

3. The device as claimed in claim 1, wherein said at least one roller includes a first roller and a second roller, said first roller and said second roller being substantially parallel so that both said first roller and said second roller may roll along the surface.

4. The device as claimed in claim 1, wherein said pump is a first pump and said supply unit further includes a second pump; wherein said duct is a first duct and said device further includes a second duct; wherein said first duct connects said first pump to said at least one roller and said second duct connects said second pump to said at least one roller; and wherein said control unit individually controls a flow rate for the first pump and a flow rate for the second pump based upon the control signal and a set linear relationship.

5. The device as claimed in claim 1, further including a rotary, speed-controlled motor, and wherein said pump is a peristaltic pump driven by said rotary, speed-controlled motor.

6. The device as claimed in claim 1, further including an extensible handle, wherein said applicator is mounted on said extensible handle.

7. The device as claimed in claim 1, wherein said at least one roller has a truncated cone shape and wherein an upper and lower end of said truncated cone shape are impervious to the liquid product.

8. The device as claimed in claim 1, wherein said applicator further includes a protection screen mounted adjacent to said at least one roller, whereby liquid product drippings or overflow from said at least one roller will be caught by said protection screen.

9. The device as claimed in claim 1, further including at least one rolling guide attached to a side of said applicator, said at least one roller having a first axis of rotation, and said at least one rolling guide having a second axis of rotation which is substantially perpendicular to the first axis of rotation.

10. The device as claimed in claim 1, wherein said control unit comprises a detection element provided for receiving said control signal and for generating a zero-speed signal when said control signal indicates a zero speed of said roller, said control unit causes under control of said zero-speed signal a return back of said liquid present in said duct towards said pump.

11. The device as claimed in claim 10, wherein said detection element is provided for generating a further zero-speed signal after lapse of a predetermined time period counted as from generating said zero-speed signal, said control unit causes under control of said further zero-speed signal to stop said return.

12. A method of operation for a machine for applying a liquid product on a surface, the machine including at least one roller, a speed detector, a volumetric pump, a duct, and a control unit, said method comprising the steps of:

selecting a linear relationship between a roller speed ($V_r$) of said at least one roller on said surface and a pump speed ($V_p$) of said pump;

applying the at least one roller against the surface;

detecting the roller speed of rotation of the at least one roller using the speed detector;

transmitting the speed, in the form of a control signal, to the control unit;

receiving the control signal at the control unit;

setting a pump speed based upon the control signal and the selected linear relationship;

operating the pump at the pump speed; and pumping the liquid product from the pump through the duct to the at least one roller.

13. A device for applying a liquid product, in particular paint, comprising an applicator with at least one roller provided for applying the product on a surface and a supply unit provided with a pump and an at least partially flexible duct connecting said pump to the applicator, said pump being connected to a control unit provided for controlling a flow of liquid to be supplied, said device comprises a detector of a motion speed of said roller on said surface, said detector being provided for furnishing a control signal corresponding to said speed, said detector being connected to said control unit which is provided for controlling said liquid product flow supplied by said pump under control of said control signal, wherein said device comprises at least one small roller applied on a lateral side of said applicator, an axis of said small roller being substantially perpendicular to the one of said roller.

* * * * *